United States Patent [19]

Haugen et al.

[11] Patent Number: 4,702,046

[45] Date of Patent: Oct. 27, 1987

[54] ACOUSTICAL WALL PANEL

[75] Inventors: Per Haugen; Harold M. Haugen, both of Sandy; Ingolf J. C. De Jong, West Valley City, all of Utah

[73] Assignee: General Communications, Inc., Murray, Utah

[21] Appl. No.: 796,111

[22] Filed: Nov. 8, 1985

[51] Int. Cl.[4] ..... E04B 1/82

[52] U.S. Cl. ..... 52/144; 52/404; 52/DIG. 13; 181/286; 181/291

[58] Field of Search ..... 52/144, 202, DIG. 13, 52/404, 145, 239, 36; 160/135, 351; 181/284–294

[56] References Cited

U.S. PATENT DOCUMENTS

| | | | |
|---|---|---|---|
| 2,671,522 | 3/1954 | Bourgeois | 52/144 X |
| 3,140,564 | 7/1964 | Chapman | 52/144 |
| 3,934,382 | 1/1976 | Gartung | 52/144 |
| 3,963,094 | 6/1976 | Nowikas | 52/144 X |
| 4,090,335 | 5/1978 | Curatolo | 52/DIG. 13 |
| 4,272,934 | 6/1981 | Cowden et al. | 52/202 |
| 4,391,073 | 7/1983 | Mollenkopf et al. | 52/239 X |
| 4,423,574 | 1/1984 | Pierre | 52/202 |
| 4,446,663 | 5/1984 | Stumpf et al. | 52/144 |
| 4,574,538 | 3/1986 | Grant | 52/404 |

FOREIGN PATENT DOCUMENTS

| | | | |
|---|---|---|---|
| WO80/00985 | 5/1980 | PCT Int'l Appl. | 52/144 |
| 1442696 | 7/1976 | United Kingdom | 52/144 |

*Primary Examiner*—J. Karl Bell

*Attorney, Agent, or Firm*—Thorpe, North & Western

[57] ABSTRACT

An acoustical wall panel for mounting on walls or similar surfaces includes a wooden support frame, low density fiberglass batts positioned within the support frame, and a generally rigid acoustical board positioned in front of and against the frame. A sheet of material is attached to the back of the frame to hold the fiberglass batts in place. The fiberglass batts and acoustical board are selected so that the batts effectively absorb acoustical energy at one end of the frequency spectrum while the acoustical board absorbs acoustical energy at the other end of the spectrum. An acoustically transparent fabric is positioned over the front surface of the acoustical board to extend over the edges of the board and support frame to the back of the frame where the fabric is attached through the sheet of material to the frame. The fabric serves to hold the acoustical board and support frame together. A mounting frame is provided for mounting the assembled acoustical wall panel to a wall or similar surface. The mounting frame and support frame include fastening elements which mate and detachably hold together when the support frame is inserted into the mounting frame.

13 Claims, 2 Drawing Figures

ACOUSTICAL WALL PANEL

BACKGROUND OF THE INVENTION

This invention relates to acoustical panels which may be readily mounted on walls or similar surfaces for both decorative purposes and absorption of sound energy.

There have been numerous proposals for acoustical panels designed to absorb acoustical energy. Examples of prior art panels or structure include those described in U.S. Pat. Nos. 3,971,867, 4,194,329, 4,040,213, 4,423,573, 4,146,999, 3,748,779, 3,712,846 and 3,948,347. These prior art acoustical panels, although providing for some sound absorption, typically suffer from problems arising from use of adhesives and films or coverings which, rather than absorbing acoustical energy, serve to reflect it. Although many of the prior art panels do include material which has high sound absorption quantities, oftentimes such material is covered with reflective material so that the acoustical energy is inhibited from reaching the sound absorbing material. An additional drawback of many of the prior art arrangements is that in the process of attempting to provide panels with good acoustical energy absorption qualities, the structural strength of the panels is compromised.

SUMMARY OF THE INVENTION

It is an object of the invention to provide an acoustical wall panel which is simple in design and easy to manufacture and install on walls or similar surfaces.

It is another object of the invention to provide such a panel which has superior acoustical energy absorption characteristics, and few or no acoustical energy reflection features.

It is a further object of the invention to provide a panel which is esthetically attractive for use on exposed walls.

It is an additional object of the invention to provide an acoustical wall panel which employs materials for both absorbing acoustical energy and providing structural strength to the panel.

It is also an object of the invention to provide such a panel capable of absorbing acoustical energy over a broad range of frequencies.

The above and other objects are realized in a specific illustrative embodiment of the invention which includes a support frame, sound absorbent batt material disposed within the frame, and a generally rigid acoustical board positioned in front of and against the frame. A generally acoustically transparent fabric is placed over the front surface of the board to extend over the edges of the board and support frame to the back of the frame where the fabric is there attached. The fabric, in addition to providing an esthetically attractive panel for placement on a wall, also serves to hold the frame and rigid acoustical board together. The combination of the support frame, batt material, acoustical board and fabric will be referred to as the acoustical insert. The acoustical wall panel also includes a mounting frame for mounting on a wall or similar surface and into which the support frame may be placed. The batt material and rigid acoustical board are selected so that one will absorb acoustical energies generally over one end of the frequency spectrum and the other absorb acoustical energies generally over the other end.

In accordance with one aspect of the invention, fasteners are provided on the acoustical insert and on the mounting frame so that when the acoustical insert is placed in the mounting frame, the fasteners mate to hold the acoustical insert in place. The fasteners are selected so that the acoustical insert may be easily installed in and removed from the mounting frame.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
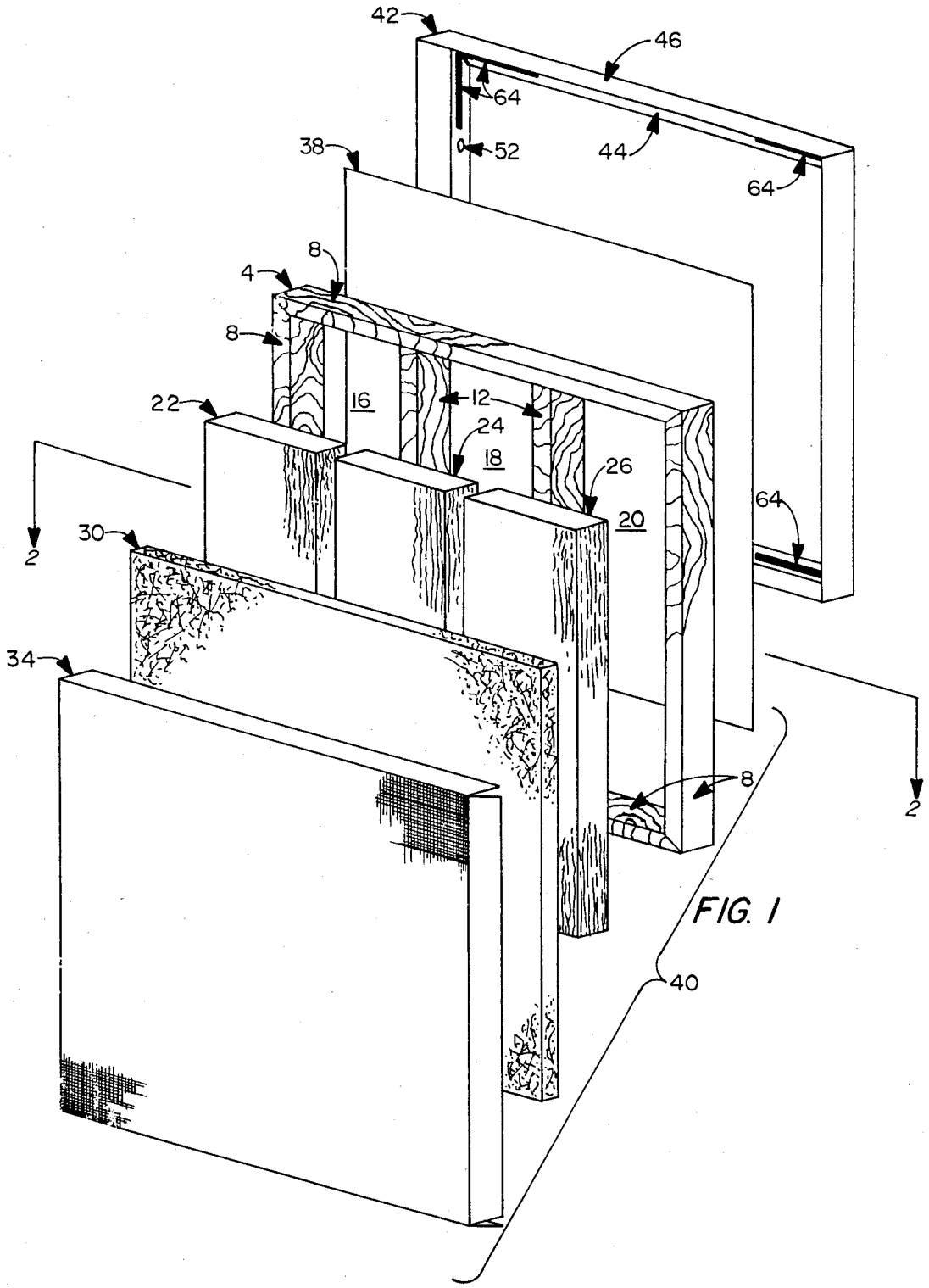
FIG. 1 shows an exploded view of an acoustic wall panel made in accordance with the principles of the present invention.
Figure 2:
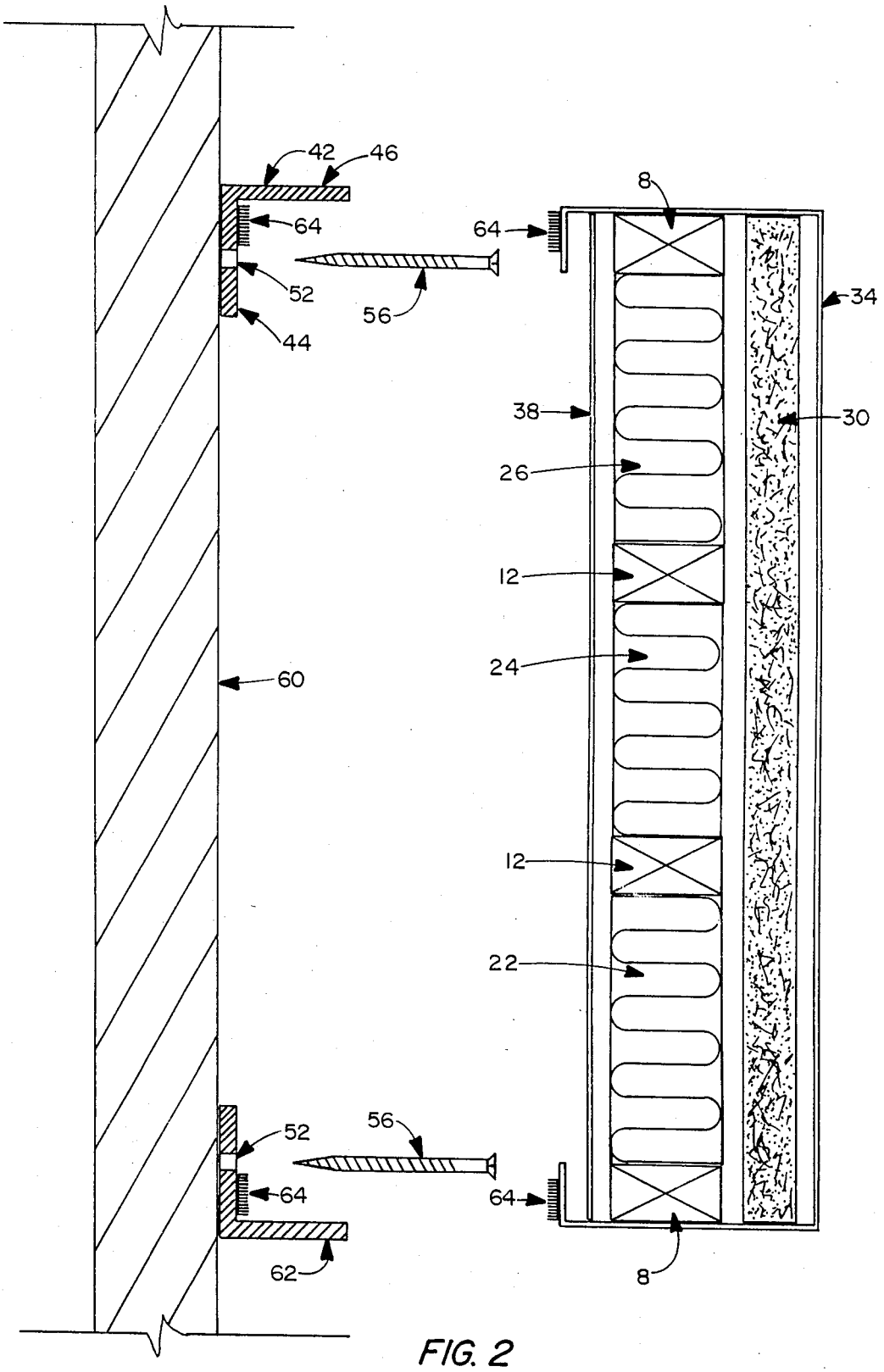
FIG. 2 shows a cross-section of the panel of FIG. 1 partially assembled and taken along lines 2—2.

There is shown in FIGS. 1 and 2 an illustrative embodiment of the acoustical wall panel of the present invention. The panel includes a wooden support frame 4 formed in the shape of a rectangle and having outside or periphery pieces 8 and cross pieces 12 which extend between opposite periphery pieces to define three interior spaces 16, 18 and 20. The support frame pieces 8 and 12 may be joined together in any suitable fashion by fasteners, adhesives, or the like. Selection of wood as the support frame provides for a fairly sturdy structure having acceptable acoustic energy absorption characteristics.

Three low density fiberglass batts 22, 24 and 26 are provided for insertion into the interior spaces 16, 18 and 20 respectively. The fiberglass batts are dimensioned to fit snuggly in the interior spaces of the support frame 4 and are compressed to have a thickness which is substantially the same as the depth of the spaces. Exemplary fiberglass which could be utilized for the batts is "Microlite" produced by Manville, and this has the capability of absorbing acoustic energy at the high end of the frequency spectrum, typically from about 500 to 4,000 c.p.s.

A generally rigid acoustical board 30 formed to have substantially the same exterior dimensions are those of the support frame 4 is provided for placement against the front of the support frame. Although FIG. 2 does not show the support frame 4 and the rigid acoustical board 30 positioned in contact with one another (for purposes of illustration), the frame and board would be so positioned. Advantageously, the acoustical board 30 is made of a wood fiber composition which provides both acoustical energy absorption capabilities and structural strength to contribute to the structural integrity of the assembled acoustical wall panel. An illustrative material which could be used is sold under the brand name "Tectum" by Tectum, Inc. The board 30 is capable of withstanding moderate impacts from objects to maintain its appearance. "Tectum" board is especially adapted to absorb acoustical energy at the low end of the frequency spectrum, typically from about 125 to 500 c.p.s. Thus, use of the fiberglass batts 22 and the board 30 together enables absorption of acoustical energy over a broad range of the sound frequency spectrum.

A fabric covering 34 is placed over the front surface of the acoustical board 30 to extend over the edges of the board and support frame 4 to locations behind the frame, as best seen in FIG. 2. The covering 34 is provided both to present an esthetically attractive appearance for the acoustical wall panel and to hold the acoustical board 30 and support frame 4 together without the use of adhesives, or other acoustical energy reflective devices. One such acceptable fabric covering 34 is made of material sold under the brand name "Chatham" by Chatham, Inc.

A thin sheet of plastic or other material 38 is placed against the rear of the support frame 4 to assist in holding the fiberglass batts 22, 24 and 26 in place during shipping, handling and mounting of the acoustical wall panel. The sheet of material 38 could be attached to the rear of the support frame 4 by an appropriate fasteners such as staples. Since such fasteners would be at the rear of the acoustical wall panel, there would be no problem with the adhesive or the fastening means reflecting acousticl energy. The edges of the fabric covering 34 are attached through the material 38 to the support frame 4.

A mounting frame 42 is formed generally in the shape of a rectangle and dimensioned to receive the combination of the support frame 4, fiberglass batts 22, 24 and 26, acoustical board 30 and fabric 34—referred to as the acoustical insert 40. The mounting frame 42 illustratively would be made of aluminum or other lightweight but rigid material, and would include a rear inwardly projecting flange or lip 44 and a forwardly projecting flange or lip 46, with the two flanges being joined together to generally form a right angle. The assembled acoustical insert 40 would then fit within the forwardly projecting flange 46.

Predrilled mounting holes 52 are provided in the inwardly projecting flange 44 to allow the insertion therein of lag bolts or wood screws 56 (or nails) for mounting the mounting frame 42 on a wall or similar surface 60 (FIG. 2).

Strips of hook and loop fasteners 64 (sold under the trademark "Velcro") are attached to the front surface of the inwardly projecting flanges 44 at the corners of the support frame 42, and on the rear surface, near the edges thereof, of the fabric covering 34.

The hook and loop fastener strips 64 are positioned on the mounting frame 42 and fabric covering 34 so that when the acoustical insert 40 is inserted into the mounting frame, the hook and loop fastener strips mate to hold the support frame, etc., in place. By using the hook and loop fastener strips 64, the acoustical insert 40 may be readily placed within the mounting frame 42, and also readily removed therefrom.

With the above-described construction, a simple, esthetically attractive and effective acoustical wall panel is provided. Typically, a plurality of such wall panels would be nested together on a wall to absorb sound energy. The wall panels are fairly lightweight and yet structurally strong to withstand rough handling and use.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. An acoustical wall panel for mounting on a wall or other surface comprising a support frame, sound absorbent batt material disposed within said frame, said material being selected to absorb acoustical energy within a certain frequency range, a generally rigid acoustical board positioned in front and against the frame, with the peripheries of the frame and board being generally coincident, said board being selected to absorb acoustical energy within a frequency range different from said certain frequency range, a generally acoustically transparent fabric positioned over the front surface of the board and extending over the edges of the board and support frame for the back of the frame where it is there attached, said fabric thereby holding the board and frame together, and a mounting frame for mounting on a wall or similar surface and for receiving and holding the support frame, board and fabric.

2. An acoustical wall panel as in claim 1 wherein said support frame is constructed of wood to include peripheral pieces and one or more cross pieces extending between the peripheral pieces to form two or more interior spaces circumscribed by the peripheral and cross pieces, and wherein said batt material is comprised of two or more sections, each disposed in a respective interior space of the frame.

3. An acoustical wall panel as in claim 1 wherein said batt material comprises a low density fiberglass material.

4. An acoustical wall panel is in claim 1 wherein said batt material is selected to absorb higher frequency acoustical energy, and wherein said board is selected to absorb lower frequency acoustical energy.

5. An acoustical wall panel as in claim 4 wherein said batt material is selected to absorb acoustical energy in the frequency range of from about 500 to 4000 c.p.s., and wherein said board is selected to absorb acoustical energy in the frequency range of from anout 125 to 500 c.p.s.

6. An acoustical wall panel as in claim 1 wherein said board is constructed of a wood fiber composition.

7. An acoustical wall panel for mounting on a wall or other surface comprising a support frame, sound absorbent batt material disposed within said frame, a generally rigid acoustical board positioned in front of and against the frame, with the peripheries of the frame and board being generally coincident, a generally acoustically transparent fabric positioned over the front surface of the board and extending over the edges of the board and support frame to the back of the frame where it is there attached, said fabric thereby holding the board and frame together, and a mounting frame formed with a rear, inwardly extending flange for attachment to the wall or other surface, and with a forward extending flange oriented generally at a right angle to the inwardly extending flange.

8. An acoustical wall panel as in claim 7 wherein the mounting frame is made of a lightweight metal composition.

9. An acoustical wall panel as in claim 7 further including first fastener elements positioned on the front surface of the inwardly extending flange, and second fastener elements positioned on that portion of the fabric extending to the back of the frame to mate with and fasten to corresponding first fastener elements when the support frame, panel and fabric are inserted into the mounting frame.

10. An acoustical wall panel as in claim 9 wherein said first and second fastener elements comprise hook and loop fasteners.

11. An acoustical wall panel as in claim 7 further including a plurality of hook and loop fasteners disposed about the mounting frame and on the fabric or support frame to mate and fasten together when the support frame, panel and fabric are inserted into the mounting frame.

12. An acoustical wall panel as in claim 7 wherein the mounting frame includes holes spaced thereabout to receive screws or nails for attaching the mounting frame to a wall or similar surface.

13. An acoustical wall panel as in claim 7 further including a sheet of material attached to the back of the support frame to hold the batt material in place within the support frame.

* * * * *